US006402608B1

(12) United States Patent
Pugliesi et al.

(10) Patent No.: US 6,402,608 B1
(45) Date of Patent: Jun. 11, 2002

(54) SHARPENER FOR DUAL PRONGED MEDICAL INSTRUMENT

(75) Inventors: Robert B. Pugliesi, Woodbury; Salvatore Cucinella, Lindenhurst, both of NY (US)

(73) Assignee: Miltex Technology Corporation, Wilmington, DE (US)

( * ) Notice: Subject to any disclaimer, the term of this patent is extended or adjusted under 35 U.S.C. 154(b) by 0 days.

(21) Appl. No.: 09/622,582

(22) PCT Filed: Feb. 17, 1999

(86) PCT No.: PCT/US99/03376

§ 371 (c)(1),
(2), (4) Date: Jan. 25, 2001

(87) PCT Pub. No.: WO99/42247

PCT Pub. Date: Aug. 26, 1999

Related U.S. Application Data

(60) Provisional application No. 60/075,158, filed on Feb. 18, 1998.

(51) Int. Cl.[7] ..... B24B 3/52

(52) U.S. Cl. ..... 451/555; 451/45; 76/82.2

(58) Field of Search ..... 451/555, 556, 451/557, 558, 45; 76/82, 82.2, 86, 88

(56) References Cited

U.S. PATENT DOCUMENTS

| | | | | | |
|---|---|---|---|---|---|
| 1,041,631 | A | * | 10/1912 | Johnson | 451/486 |
| 1,051,333 | A | * | 1/1913 | Jacoby | 76/82.2 |
| 4,258,592 | A | * | 3/1981 | Linden | 76/82.2 |
| 5,679,068 | A | * | 10/1997 | Byers et al. | 451/557 |
| 6,149,662 | A | * | 11/2000 | Pugliesi et al. | 451/45 |

* cited by examiner

*Primary Examiner*—Robert A. Rose
(74) *Attorney, Agent, or Firm*—Levine & Mandelbaum

(57) ABSTRACT

A sharpener (1) for a medical instrument has a housing (2) with an opening (3) for receiving the fingers of a hand and a sharpening element (6), having an abrasive surface (1), bisecting another opening (9) and defining two apertures **(9*a*/9*b*)** for respectively receiving the prongs of an instrument having edges which can be sharpened by simultaneously drawing them across the sharpening element.

7 Claims, 2 Drawing Sheets

SHARPENER FOR DUAL PRONGED MEDICAL INSTRUMENT

This application claims priority under provisional U.S. Patent Application Ser. No. 60/075,158 filed Feb. 18, 1998.

BACKGROUND OF THE INVENTION

This invention relates to the art of sharpening the working ends of medical instruments having two prongs with respective sharpenable edges such as nippers, forceps, scalers, and the like.

Hand held medical instruments have traditionally been sharpened by sending the instrument to a dealer or technician, or by using very costly electronic units that allow for the sharpening of instruments on site by a trained technician. When sending instruments out for sharpening, they are unavailable for use, normally for not less than a week. Also, it is relatively expensive to have an instrument sent out for professional processing each time sharpening is required. A trained technician using conventional electronic sharpening devices can sharpen an instrument on premises, but the instrument must be re-sterilized before it can be used.

SUMMARY OF THE INVENTION

The present invention provides a sharpener for a medical instrument having two prongs which are movable with respect to one another about an axis of rotation, each of which has a sharpenable edge in a respective plane oblique to the axis of rotation, including a housing having a first opening which is shaped to accept the fingers of a hand, a second opening in spaced relationship to said first opening, and a sharpening element, having an abrasive surface, mounted on the housing and bisecting the second opening thereby defining two apertures for respectively receiving the prongs of the instrument whereby the edges of the instrument can be simultaneously drawn over the sharpening element for sharpening them.

It is therefore an object of the invention to provide a medical instrument sharpening tool that is easier to use than prior art sharpening tools for medical instruments.

Another object of the invention to provide a medical instrument sharpening tool that can be hand held during use.

Still another object of the invention to provide a medical instrument sharpening tool that can be sterilized to prevent contamination of the medical instruments that it is used to sharpen.

A further object of the invention to provide a medical instrument sharpening tool that can be readily used to sharpen an instrument without need to take the instrument out of service for more than a short period of time.

Still a further object of the invention to provide a medical instrument sharpening tool that is relatively inexpensive.

Other and further objects of the invention will be apparent from the following drawings and description of a preferred embodiment of the invention in which like reference numerals are used to indicate like parts in the various views.

DESCRIPTION OF THE PREFERRED EMBODIMENT

Figure 1:
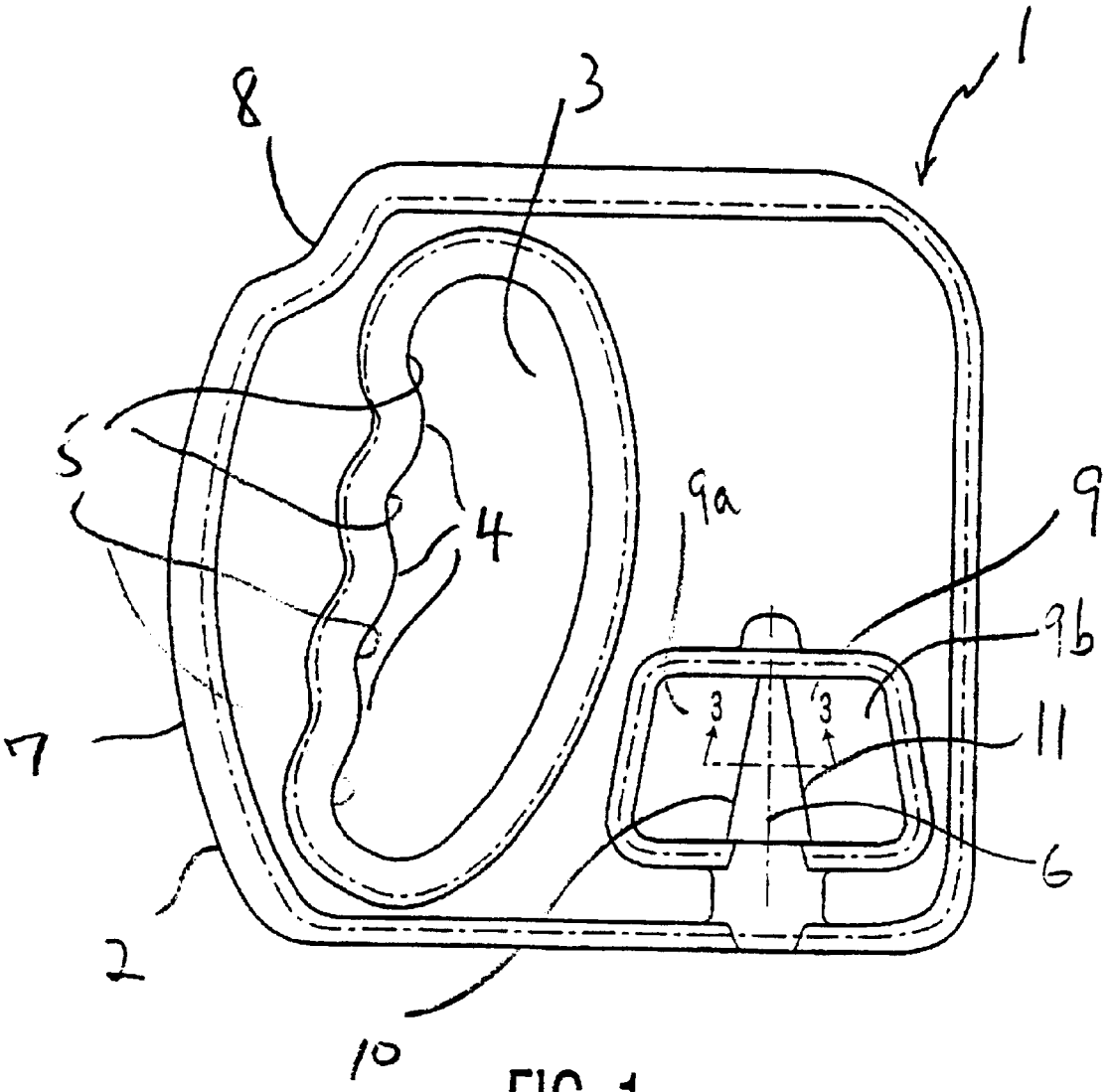
FIG. 1 is a side elevation view of the preferred embodiment of the invention.
Figure 2:
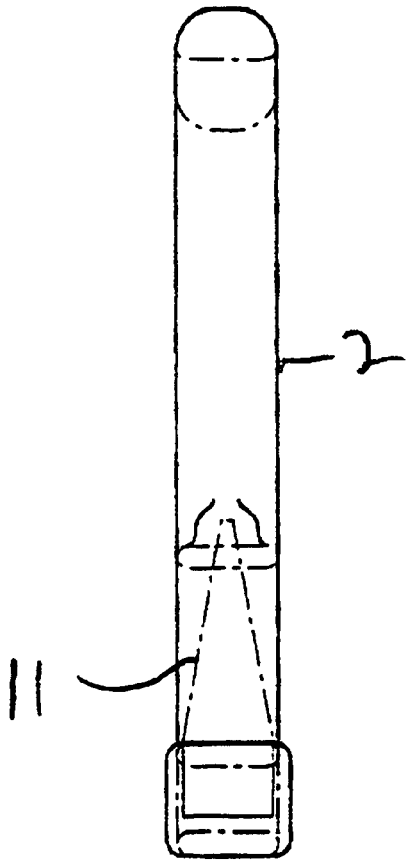
FIG. 2 is an end elevation view of the preferred embodiment of the invention.
Figure 3:
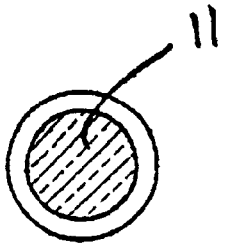
FIG. 3 is a cross sectional view of the preferred embodiment of the invention taken through line 3—3 of FIG. 1.

Referring now to the drawing, a sharpener 1 for a medical instrument having two prongs which are movable with respect to one another about an axis of rotation, each of which has a sharpenable edge in a respective plane oblique to said axis of rotation, e.g., nippers, forceps and the like, has a housing 2 molded from an autoclavable high temperature plastic such as Lexan or other medical grade material having similar properties. The housing 2 has an opening 3 which is shaped to accept the fingers of either hand. Three knuckles 4 separate four indentations 5 within the opening 3 to accommodate four fingers of a hand, and a dimple 8 on the outer circumference of the housing 2 is provided for receiving a padded portion of a thumb of the user which can be positioned along a rear edge 7 on the outer circumference of the housing 2 to firmly and securely grasp the sharpener 1.

A frustoconically shaped sharpening stone 11 in the shape of a truncated cone is centrally mounted within and bisects a generally trapezoidal opening 9 spaced from the finger receiving opening 3 within the housing 2. The sharpening stone 11 has a longitudinal axis 6 traversing the opening 9 and an abrasive surface 10 tangential to a plane oblique to the longitudinal axis 6. Two symmetric apertures 9*a* and 9*b* formed by the bisection of the opening 9 are respectively able to receive the prongs of a dual pronged instrument whereby sharpenable edges on each prong of the instrument can be simultaneously drawn over the sharpening element for sharpening them.

The angle of a plane, tangential to the curved surface of the frustoconical sharpening stone 11, to the base of the cone formed by the stone 11 is a function of the angle between the edge of the instrument to be sharpened and the axis of rotation of the prongs of the instrument. The sharpening stone is preferably designed so that diametrically opposite planes tangential to its frustoconical surface intersect the longitudinal axis 6 at angles substantially equal to angles at which the respective planes of the edges of the instrument prongs which are to be sharpened intersect the axis of rotation of the prongs.

The sharpening stone 11 is preferably made of aluminum oxide or similar material suitable for honing a sharp edge on a steel instrument. In the preferred embodiment of the invention, the sharpening stone 11 is formed from aluminum oxide in an amount of 50%–90% by weight and other oxides in an amount of 5%–50% by weight.

In use on a dual pronged instrument, such as pair of nippers, the nippers are opened to separate the working ends on the respective prongs, and the cutting-edges of the working ends are respectively inserted through the openings 9*a,b* adjacent the top of the stone 11 where its diameter is the smallest. The nippers are then gently closed against the sharpening stone and vertically lowered and pulled outwardly with the edges rubbing against the sharpening stone to form a sharp edge.

Thus it will be seen that the objects of the invention have been achieved. Medical nippers, forceps, scalers and other dual pronged instruments can be sharpened using the hand-held sharpener of the instant invention. Such instruments can be sharpened by swiping the cutting edge over a specifically angled ceramic stone. The sharpening unit itself is sterilizable, making it usable during procedures without need for resterilization. The sharpening unit is designed so that anyone can pick-up the unit and, in minutes, sharpen instruments with professional results.

What is claimed is:

1. A sharpener for a medical instrument having two prongs which are movable with respect to one another about an axis of rotation, each of which has a sharpenable edge in a respective plane oblique to said axis of rotation, comprising a housing having a first opening which is shaped to accept the fingers of a hand, a second opening in spaced relationship to said first opening, and a sharpening element, having an abrasive surface, mounted on said housing and bisecting said second opening thereby defining two apertures for respectively receiving the prongs of said instrument whereby said edges of said instrument can be simultaneously drawn over said sharpening element for sharpening them, the sharpening element comprising aluminum oxide in an amount of 50%–90% by weight and other oxides in an amount of 5%–50% by weight.

2. A sharpener for a medical instrument having two prongs which are movable with respect to one another about an axis of rotation, each of which has a sharpenable edge in a respective plane oblique to said axis of rotation, comprising a housing having a first opening which is shaped to accept the fingers of a hand, a second opening in spaced relationship to said first opening, and a sharpening element, having an abrasive surface, mounted on said housing and bisecting said second opening thereby defining two apertures for respectively receiving the prongs of said instrument whereby said edges of said instrument can be simultaneously drawn over said sharpening element for sharpening them, said first aperture having a major diameter large enough to enable four fingers of a human hand to be received therein to enable gripping of the housing with a thumb of the hand in engagement with a surface of a perimeter of the housing.

3. A sharpener for a medical instrument having two prongs which are movable with respect to one another about an axis of rotation, each of which has a sharpenable edge in a respective plane oblique to said axis of rotation, comprising a housing having a first opening which is shaped to accept the fingers of a hand, a second opening in spaced relationship to said first opening, and a sharpening element, having an abrasive surface, mounted on said housing and bisecting said second opening thereby defining two apertures for respectively receiving the prongs of said instrument whereby said edges of said instrument can be simultaneously drawn over said sharpening element for sharpening them, said sharpening element having a longitudinal axis traversing said second opening and an abrasive surface tangential to a plane oblique to said longitudinal axis.

4. A sharpener for a medical instrument in accordance with claim 3 wherein said sharpening stone is frustoconical in shape.

5. A sharpener for a medical instrument in accordance with claim 4 wherein diametrically opposite planes tangential to the frustoconical surface of said sharpening element intersect said longitudinal axis at angles substantially equal to angles at which said respective planes of said edges intersect said axis of rotation of said prongs.

6. A sharpener for a medical instrument having two prongs which are movable with respect to one another about an axis of rotation, each of which has a sharpenable edge in a respective plane oblique to said axis of rotation, comprising a housing having a first opening which is shaped to accept the fingers of a hand, a second opening in spaced relationship to said first opening, and a sharpening element, having an abrasive surface, mounted on said housing and bisecting said second opening thereby defining two apertures for respectively receiving the prongs of said instrument whereby said edges of said instrument can be simultaneously drawn over said sharpening element for sharpening them, a wall of the housing circumscribing the first opening having grooves for receiving fingers to aid in grasping.

7. A sharpener for a medical instrument in accordance with claim 6 wherein the housing has an outer circumferential wall with a dimple for receiving a thumb.

* * * * *